US010888758B2

(12) United States Patent
Bair et al.

(10) Patent No.: US 10,888,758 B2
(45) **Date of Patent: *Jan. 12, 2021**

(54) CONFIGURABLE WATER MAT

(71) Applicant: Bair Products, Inc., Louisburg, KS (US)

(72) Inventors: Tonya Bair, Overland Park, KS (US); Larry Bair, Louisburg, KS (US)

(73) Assignee: Bair Products, Inc., Louisburg, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/363,331

(22) Filed: Mar. 25, 2019

(65) Prior Publication Data

US 2019/0217174 A1 Jul. 18, 2019

Related U.S. Application Data

(63) Continuation of application No. 15/605,302, filed on May 25, 2017, now Pat. No. 10,238,939.

(60) Provisional application No. 62/341,723, filed on May 26, 2016, provisional application No. 62/381,226, filed on Aug. 30, 2016, provisional application No. 62/404,891, filed on Oct. 6, 2016.

(51) Int. Cl.

| | |
|---|---|
| ***B63B 35/58*** | (2006.01) |
| ***A63B 69/00*** | (2006.01) |
| ***A47C 27/08*** | (2006.01) |
| ***A63G 31/00*** | (2006.01) |
| ***A63H 23/10*** | (2006.01) |
| *B63B 21/04* | (2006.01) |
| *B63B 34/50* | (2020.01) |

(52) U.S. Cl.

CPC ..... *A63B 69/00* (2013.01); *A47C 27/088* (2013.01); *A63G 31/007* (2013.01); *A63H 23/10* (2013.01); *B63B 21/04* (2013.01); *B63B 34/50* (2020.02)

(58) Field of Classification Search

CPC .. B63B 7/00; B63B 7/08; B63B 35/74; B63B 35/76; B63B 35/78; A47C 27/081; A47C 27/087

See application file for complete search history.

(56) References Cited

U.S. PATENT DOCUMENTS

| | | | | |
|---|---|---|---|---|
| 6,062,930 | A * | 5/2000 | Smith | B63B 7/02 441/129 |
| 10,238,939 | B2 * | 3/2019 | Bair | A63G 31/007 |
| 2007/0238375 | A1 * | 10/2007 | Arenson | B63B 32/51 441/65 |
| 2010/0227124 | A1 * | 9/2010 | Sharir | A47G 27/0212 428/159 |
| 2014/0346824 | A1 * | 11/2014 | Harrison | A47C 15/006 297/219.1 |

* cited by examiner

*Primary Examiner* — Andrew Polay
(74) *Attorney, Agent, or Firm* — Erise IP, P.A.

(57) ABSTRACT

A water mat assembly having selectively attachable modular panels is disclosed. The water mat comprises a buoyant solid core insert that is inserted into a sleeve made of fabric. The sleeve may be couple to other sleeves to form an assembly of floating panels. The end panels may have grommeted ports for tethering the mat assembly to a dock or water vehicle.

20 Claims, 7 Drawing Sheets

CONFIGURABLE WATER MAT

RELATED APPLICATIONS

This continuation application claims prior benefit, with regard to all common subject matter, of earlier-filed U.S. patent application Ser. No. 15/605,302, filed May 25, 2017, and entitled "CONFIGURABLE WATER MAT." The identified '302 patent application is hereby incorporated by reference in its entirety into the present application.

This non-provisional application claims prior benefit, with regard to all common subject matter, of earlier-filed U.S. Provisional Patent Application No. 62/404,891, filed Oct. 6, 2016, and entitled "CONFIGURABLE WATER MAT." The identified '891 provisional patent application is hereby incorporated by reference in its entirety into the present application.

This non-provisional application claims prior benefit, with regard to all common subject matter, of earlier-filed U.S. Provisional Patent Application No. 62/381,226, filed Aug. 30, 2016, and entitled "CONFIGURABLE WATER MAT". The identified '226 provisional patent application is hereby incorporated by reference in its entirety into the present application.

This non-provisional application claims prior benefit, with regard to all common subject matter, of earlier-filed U.S. Provisional Patent Application No. 62/341,723, filed May 26, 2016, and entitled "CONFIGURABLE WATER MAT". The identified '723 provisional patent application is hereby incorporated by reference in its entirety into the present application.

BACKGROUND

1. Field

Embodiments of the invention are broadly directed to a floating water mat. More specifically, embodiments of the invention provide a solid core, buoyant mat for supporting multiple people or objects on the water with an adjustable width or length and configurable folding shape.

2. Related Art

Water mats are popular recreational floatation devices. Current water mats provide little more than a single, continuous flat slab of foam that is intended to be rolled up for storage. Problems arise when a mat has spent too much time rolled up, causing it to no longer lay flat when unrolled. Further, rolling these mats often requires cooperation between multiple people. Once rolled, current mats do not store well in areas of limited space, such as a boat, garage, dock, or vehicle, and are difficult to carry by a single person. What is needed is an improved water mat that can be lengthened or shortened as desired, remains generally flat while in use, and can be conveniently folded for storage and transportation by a single person.

SUMMARY

Embodiments of the invention solve these problems by providing a recreational floating water mat comprised of modular sections that can be added or removed to adjust its overall length and folded up for simple transportation and storage. This modular construction further allows the water mat to be easily repaired if damaged, and may be used to select different color combinations. The sections of the water mat in embodiments of the invention are substantially similar to one another, and are covered in a resilient, colorful fabric that may be removed for cleaning, color modification, and/or replacement due to damage. The sections may be personalized, for instance using embroidery, or a heat seal logo or name.

A first embodiment of the invention addresses the above-described needs by providing a configurable water mat comprising an anchor section and an intermediary section. The anchor section includes a first buoyant insert, a first sleeve, a first enclosure fastener, at least one tethering port, and a first expansion fastener. The first sleeve includes a first face, a second face opposite the first face, a first edge, and a second edge. The first enclosure fastener is operable to enclose the first buoyant insert within the first sleeve. The least one tethering port is positioned along the first edge, and the first expansion fastener is positioned along the second edge. The intermediary section includes a second buoyant insert, a second sleeve, a second enclosure fastener, a second expansion fastener, and a third expansion fastener. The second sleeve includes a third face, a fourth face, a third edge, a fourth edge. The second enclosure fastener is operable to enclose the second buoyant insert within the second sleeve. The second expansion fastener is disposed along the third edge and is operable to couple to the first expansion fastener on the first sleeve. The third expansion fastener along the fourth edge is operable to couple to an additional expansion fastener on a third sleeve associated with an additional mat section.

A second embodiment of the invention addresses the above-described needs by providing for a configurable water mat comprising a first anchor section, a second anchor section, and a set of intermediary sections. The first anchor section and the second anchor section each include a first buoyant insert, a first sleeve, a first enclosure fastener, at least one tethering port, and a first expansion fastener. The first sleeve includes a first face, a second face opposite the first face, a first edge, and a second edge. The first enclosure fastener is operable to enclose the first buoyant insert within the first sleeve. The at least one tethering port positioned along the first edge, and the first expansion fastener along the second edge. The set of intermediary sections is configured to be disposed between the first anchor section and the second anchor section. Each intermediary section of the set of intermediary sections includes a second buoyant insert, a second sleeve, a second enclosure fastener, a second expansion fastener, and a third expansion fastener. The second sleeve includes a third face, a fourth face, a third edge, a fourth edge. The second enclosure fastener operable to enclose the second buoyant insert within the second sleeve. The second expansion fastener along the third edge operable to couple to the first expansion fastener on the first sleeve. The third expansion fastener along the fourth edge operable to couple to an additional expansion fastener on a third sleeve associated with an additional mat section.

A third embodiment of the invention addresses the above-described needs by providing a configurable water mat comprising an anchor section and an intermediary section. The anchor section includes a first buoyant insert, a first sleeve, a first enclosure fastener, at least one tethering port, and a first expansion fastener. The first sleeve includes a first face, a second face opposite the first face, a first edge, and a second edge. The first enclosure fastener is operable to enclose the first buoyant insert within the first sleeve. The least one tethering port is positioned along the first edge, and the first expansion fastener is positioned along the second edge. The intermediary section includes a second buoyant insert, a second sleeve, a second enclosure fastener, a second expansion fastener, and a third expansion fastener. The second sleeve includes a third face, a fourth face, a third edge, a fourth edge. The second enclosure fastener is operable to enclose the second buoyant insert within the second sleeve. The second expansion fastener is disposed along the third edge and is operable to couple to the first expansion fastener on the first sleeve. The third expansion fastener along the fourth edge is operable to couple to an additional expansion fastener on a third sleeve associated with an additional mat section. The configurable water mat is configured to be placed into either of an expanded configuration and a stacked configuration. In the stacked configuration, the first face of the first sleeve contacts the third face of the second sleeve. In the expanded configuration the first face of the first sleeve is substantially coplanar with the third face of the second sleeve.

BRIEF DESCRIPTION OF THE DRAWINGS

Embodiments of the invention are described in detail below with reference to the attached drawing figures, wherein.

Figure 1:
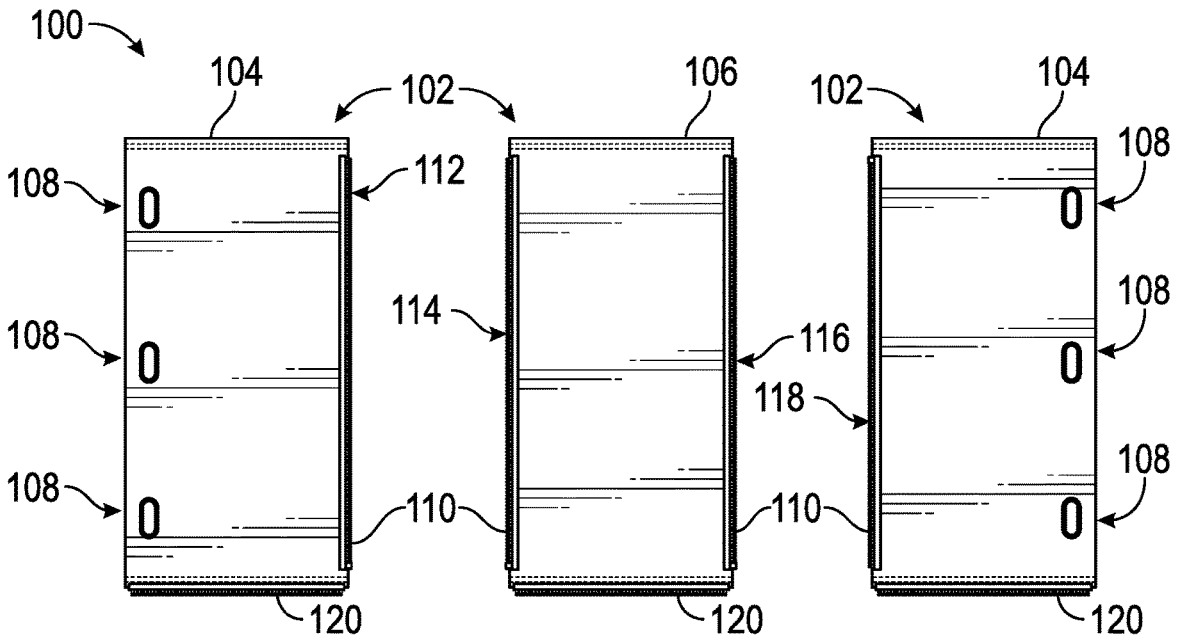
FIG. 1 depicts an exemplary embodiment of a configurable water mat with three separate panels.

The drawing figures do not limit embodiments the invention to the specific embodiments disclosed and described herein. The drawings are not necessarily to scale, emphasis instead being placed upon clearly illustrating the principles of the invention.

DETAILED DESCRIPTION

The following description of embodiments of the invention references the accompanying illustrations that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to the figures, embodiments of the invention are directed to a configurable water mat 100. Embodiments of the invention may be used as a recreational device on which multiple people can stand, sit, lie, or exercise. Embodiments may also be used while swimming to allow swimmers to easily enter and exit the water. Embodiments may be free-floating, secured to a stationary platform (such as a dock), or secured to a movable platform (such as a boat). Embodiments may hold a Personal Water Craft (PWC) or other water-related recreational items such as a kayak, standup paddleboard, tube, etc. Embodiments may be used for towing the configurable water mat 100 in rescue operations such as for a stranded swimmer, or a fallen surfer surfing large waves, to grab and be pulled out of harm's way. A customizable graphic on the configurable water mat 100 may be displayed at water sporting events for the purpose of promotion or sponsorship. It should therefore be appreciated that the discussed uses herein are only exemplary and that embodiments of the invention may be used for any of many purposes and uses.

Broadly, the configurable water mat 100 is a combination of one or more fabric sleeves that cover a solid core buoyant foam insert. The combination of one sleeve and one foam insert will be referred to as a panel. Multiple panels are attached together allowing a user to attach as many panels as wanted. There are two end panels that have grommeted ports on one side and fasteners on the opposite side. These ports are for attaching a tether and anchoring the configurable water mat 100 to any number of objects that may be used for different purposes that will be discussed in detail later. Since the center panels have fasteners on opposite edges, the center panels may be coupled to each other as well as the outer anchoring sections. This allows for a plurality of center panels and the assembly may be made as long as a user wishes. Anchor sections may be placed at one end, both ends or no anchor section may be attached. Anchor sections may also be placed on the ends, or edges of the intermediary sections, or two anchor sections may be attached. The embodiment here and the embodiments following use a rectangular shaped mat as an example. However, the panels may be any number of shapes and sizes that can be attached together including but now limited to square, triangular, circular, or rhombus. The size and shape of the panels may be irregular or optimized based on space, material, or weight and size of the user.

The configurable water mat 100 is formed of at least two mat sections 102. The mat sections 102 are separate and distinct structures that may be secured (permanently or selectively) to each other to form the configurable water mat 100. Mat sections 102 may be of various types. For example, a mat section 102 may be an anchor section 104 or an intermediary section 106. An anchor section 104 is configured to be secured to an external structure, such as a dock or boat as discussed below, as well as other mat sections 102. An intermediary section 106 is configured to be secured only to other mat sections 102. As such, various intermediary sections 106 may be secured between one or more anchor sections 104. The mat sections 102 of various types are therefore combined as desired by a user to form the completed configurable water mat 100.

In an exemplary embodiment depicted in FIG. 1, two anchor sections 104 are separate from a single intermediary section 106. The two anchor sections 104 each have a plurality of grommeted ports 108 for securing a tether, a rope, a clamp, or any other object that be useful for anchoring the configurable water mat 100. The mat sections 102 are attachable to one another using a zipper segment 110 along the edges 112, 114, 116, and 118. Two zipper segments 110 are combined and secured so as to form the configurable water mat 100. These edges 112, 114, 116, and 118 are exemplary, as any edge may include a zipper segment 110 or otherwise be configured for securing to another mat section. In some embodiments, the zipper segment may be associated with an enclosure fastener 120 for providing removable functionality, as described below.

Figure 2:
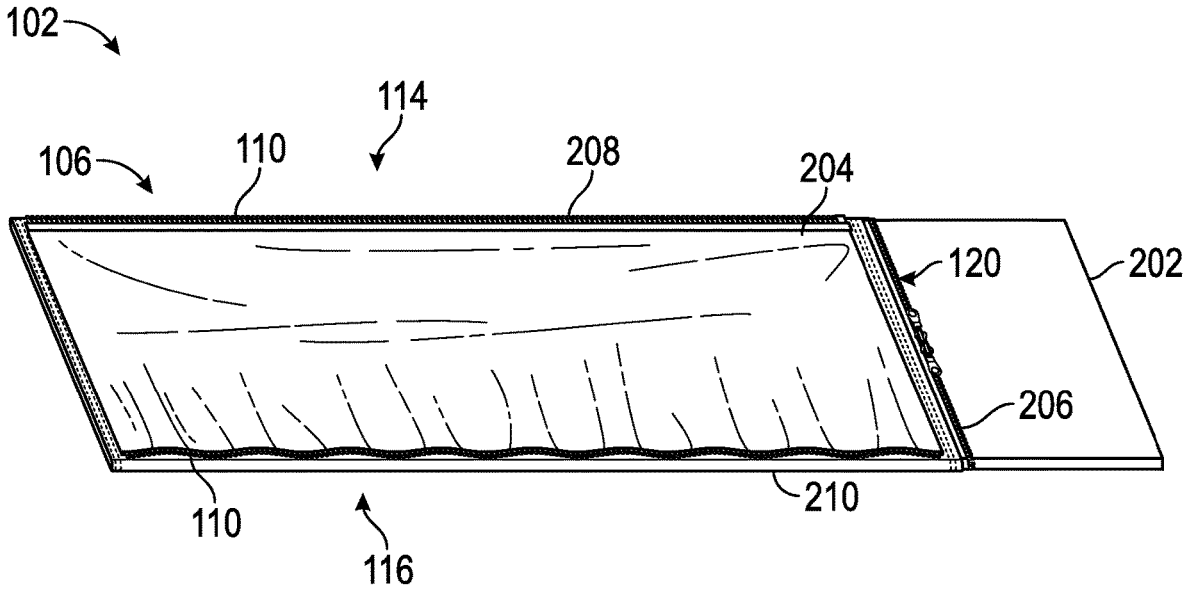
FIG. 2 depicts a sleeve and buoyant insert.

In embodiments of the invention, as illustrated in FIG. 2, the mat section 102 comprises an insert 202 and a sleeve 204. In some embodiments the insert 202 is a solid core buoyant foam insert. The sleeve 204 has the enclosure fastener 120, in this embodiment zipper 206. The enclosure fastener 120 is configured to be placed into an open and a closed configuration. In the open configuration, the sleeve 204 allows insertion of the insert 202. In the closed configuration the sleeve 204 secures the insert 202 therein. Since the intermediary section 106 of FIG. 1 is depicted, zippers 208 and 210 are on the edges 114 and 116 of the sleeve 204 for attaching to other intermediary sections 106 and/or anchor sections 104. In some embodiments, the zipper segment 110 is sewn into the fabric cover (shown in FIG. 2 and discussed below).

In embodiments of the invention, the mat sections 102 are buoyant because of a solid core of buoyant foam for insert/removal. The insert 202 is inserted through the enclosure fastener 120 in the open configuration. Once the insert 202 is fully inserted the opening is closed using the enclosure fastener 120, such as the zipper 206 as illustrated. It should be appreciated that while the fasteners in this embodiment and the embodiments follow may be zippers, this is in no way limiting and other fasteners such as buttons, hooks, snaps, magnets, general purpose adhesive backed fasteners, clamps, surface area based fasteners, sealants, straps or any other fastening device may be used.

In embodiments of the invention, the mat sections 102 present a generally rectangular prism shape, as shown in FIGS. 1 and 2. The rectangular shape of the mat sections 102 each present a long side and a short side. In some embodiments, such as shown in FIG. 1, the long sides are configured to connect and the short sides are configured to be open (e.g., not connected). In other embodiments, not illustrated, the short sides are configured to connect and the long sides are configured to be open. In still other embodiments, both the short sides and the long sides are configured to connect, such that the user may expand the configurable water mat 100 in more than one direction. The fasteners may be located on the short ends instead of or in addition to the long ends. Similarly, the grommets 108 may be on the short sides providing the user with the ability to assemble the panels in a lengthwise manner rather than width based as depicted. The mat sections 102 may be any color or combination of colors. For example, a combination of three mat sections 102, such as shown in FIG. 1, may be red, white, and blue respectively. As another example, each mat section 102 may be bright orange or other high visibility color to increase safety on the water so operators of passing boats can see the configurable water mat 100 easily.

Figure 3:
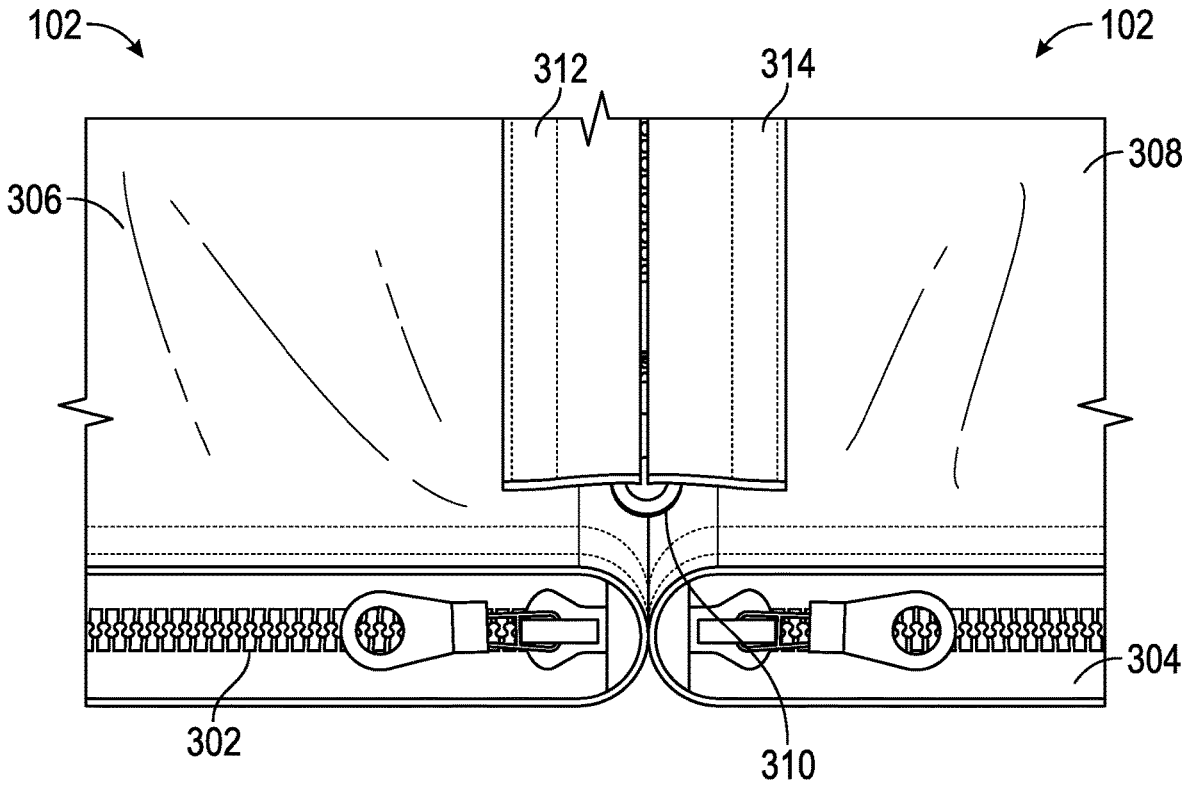
FIG. 3 depicts fasteners for attaching a first face of a sleeve to a second face of a sleeve and a second fastener for attaching a first sleeve to a second sleeve.

Further depicted in FIG. 3 is an example of how the mat sections 102 are coupled and how the inserts 202 are inserted. In this embodiment zippers 302 and 304 are used as the enclosure fasteners 120 to secure the inserts 202 inside their respective sleeves 204 (shown as sleeves 306 and 308, respectively). The sleeves 306 and 308 are attached by zipper 310 that is under flaps 312 and 314. The flap 312 on sleeve 306 and flap 314 on sleeve 308 cover the zipper 310. This is to provide protection from both water getting into the seam and for the user laying on the configurable water mat 100. The zipper 310 may provide discomfort to a user on the configurable water mat 100 so the flaps 312 and 314 provide a barrier. The flaps 312 and 314 may also be equipped with fasteners for attaching to each other. An adhesive backed fastener, buttons, snaps or magnets are just a few non-limiting examples of attachments that may be used to hold flaps 312 and 314 together. The flaps 312 and 314 may partially or wholly cover the attachment. There may not be a need for two flaps and only one flap on one side may cover the attachment. In this case, there would only be one flap on each panel that may attach to the other panel by any of the attachment methods previously stated.

Figure 4A:
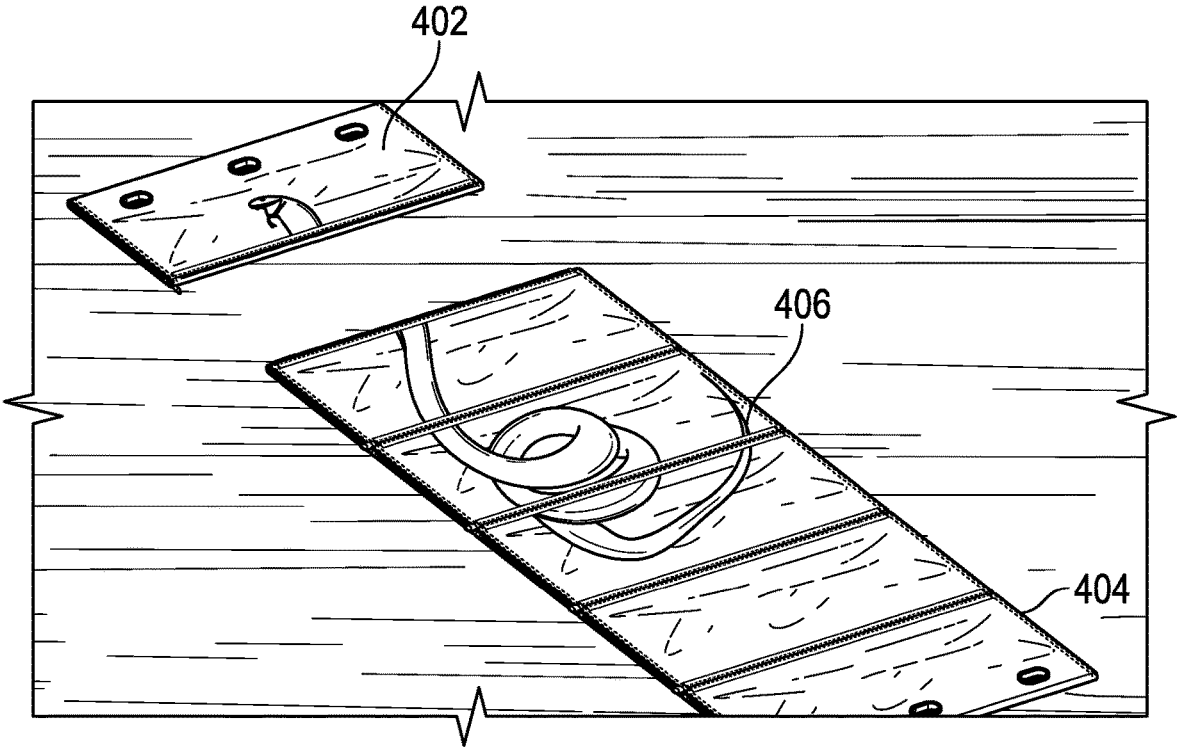
FIG. 4A depicts a mat in the water with several panels attached and one panel separate with an incomplete graphic displayed on the panels.
Figure 4B:
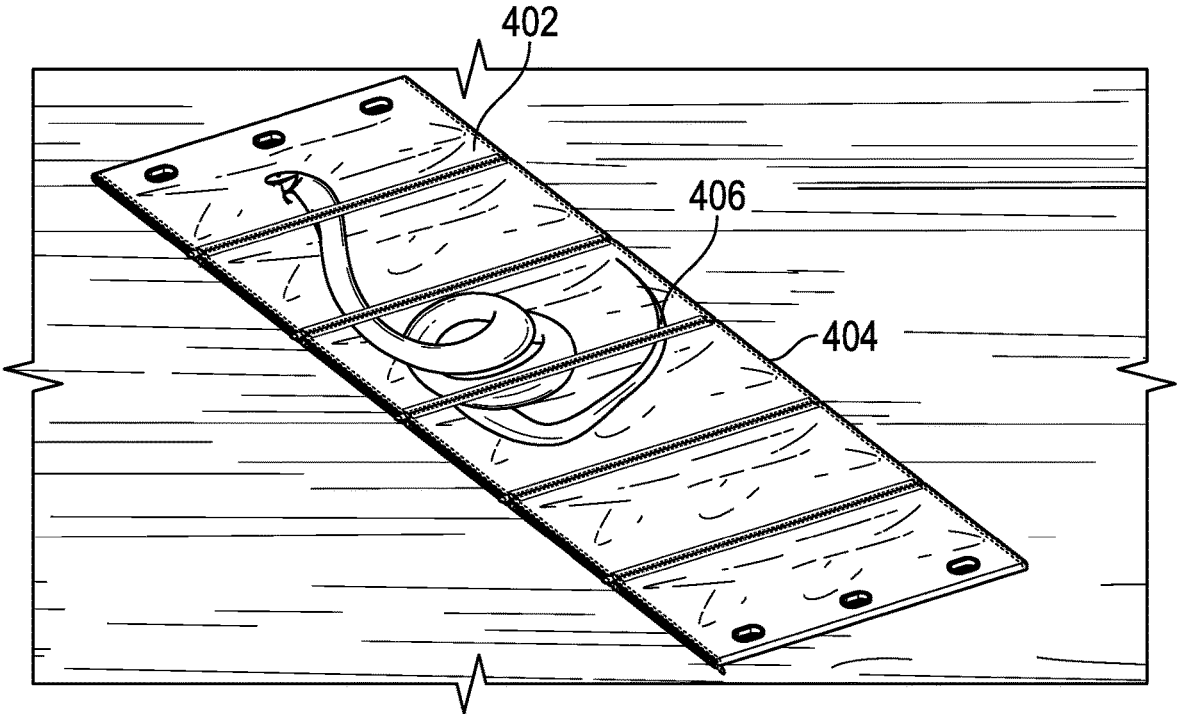
FIG. 4B depicts a fully assembled mat with a graphic displayed in its entirety.

FIGS. 4A and 4B depict an exemplary embodiment of a mat assembled in water. In FIG. 4A it can be seen that the configurable water mat 100 is not completely assembled. A mat section 102 (labeled as mat section 402) is floating separately from the configurable water mat (labeled as 404). The configurable water mat 100 may be assembled in water as well as on land. This provides ease of assembly and the ability to attach more panels. Since all panels may be the same, it may be possible to incorporate panels from other groups such as, if the user meets other users at an event and would like to make a larger mat assembly, or if the number of people is greater than the number of panels, more panels may be added without removing from the water.

FIG. 4 also illustrates a graphic 406 (such as a decal or other representation) that is printed on the sleeves 204 of the mat sections 102. In this example, the graphic 406 has been printed across multiple mat sections 102 so that the panels must be in the correct order and fully assembled for viewing. Since panel 402 is not attached the full graphic is not together. This is exemplary and complete graphics may be printed on individual panels. The graphic 406 may be customizable, or chosen from a group of predesigned graphics. The graphics may be advertisements for marketing and/or sponsorships. The graphic may be pictures, phrases, or scenes. In FIG. 4B the configurable water mat 100 is fully assembled and the graphic is easily understood. The panel 402 has been fastened to the configurable water mat 404 and the graphic 406 is entirely viewable.

Figure 5:
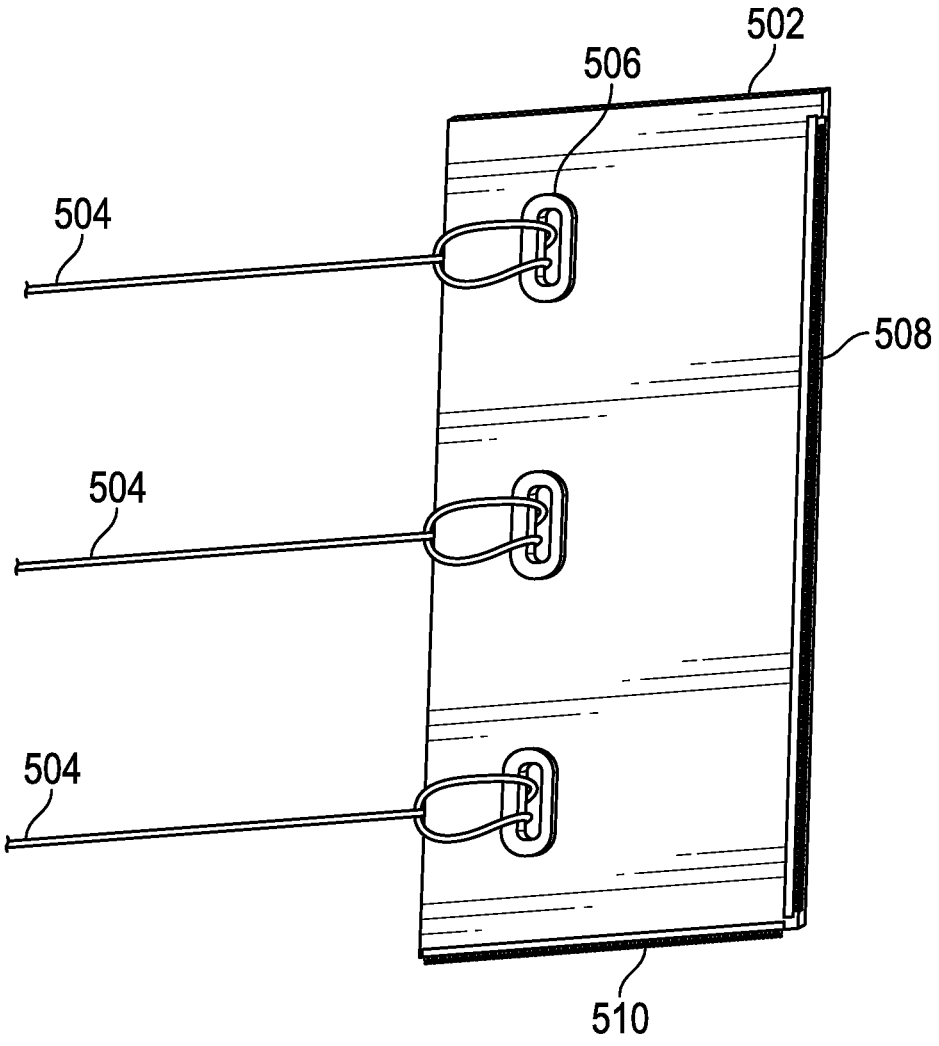
FIG. 5 depicts an anchor panel with tethers secured to grommeted ports.

In an exemplary embodiment depicted in FIG. 5 an anchor panel 502 and tethers 504 are attached to grommets 506. Anchor panel 502 has expansion fasteners 508 along one edge identical to those described for the middle mat sections. The expansion fasteners secure each successive sleeve expanding the overall mat assembly. Anchor panel 502 additionally include the same fastenable openings 510 for insertion and removal of a foam core. The remaining edge of the anchor panel 502 may include a plurality of grommeted ports 506 for mooring, docking, or otherwise connection of the anchor panel 502 to another object. For instance, these ports 506 may be used to tether the anchor panel 502 to a motorboat using a towrope, to moor the mat to a dock using looped bungees for easier entry to and exit from a body of water, and/or to tie the edges of the anchor panel 502 to another mat for temporary connection. In the present embodiment looped bungies 504 are used. These are intended only as example uses of the tethers and grommeted ports, and are not intended as limiting. The grommeted ports 506 further enable convenient grasping and carrying of the configurable water mat 100.

In embodiments of the invention, as illustrated in FIG. 5, employs three grommets 506 formed of high durability plastic, but this is merely exemplary and is not intended to be limiting to the invention. Any number of grommets 506 may be constructed of any particular material, including but not limited to plastic, metal, rubber, fabric, foam, or wood. In some embodiments, the ports may not be grommeted, or may have removable grommets. If the foam and sleeve material is strong enough to prevent tearing from the tether 504 being used, the grommets 506 may not be necessary, and only the ports be used. The grommets 506 may also be removable to have only the mat exposed to the user in the event that the anchor panel 502 is not tethered. The tethers 504 attached to the grommeted ports 506 may be removable or permanently affixed. Tethers 504 may also be formed of any chosen material, including but not limited to cord, chain, rope, and fabric. Tethers 504 may have a clasp, loop or other fastening mechanism at distal ends. The tethers 504 may be attached to movable objects such as boats or other water craft. Both the tethers 504 and the grommets 506 are made to withstand reasonable forces that are applied under these normal operating conditions.

Figure 6:
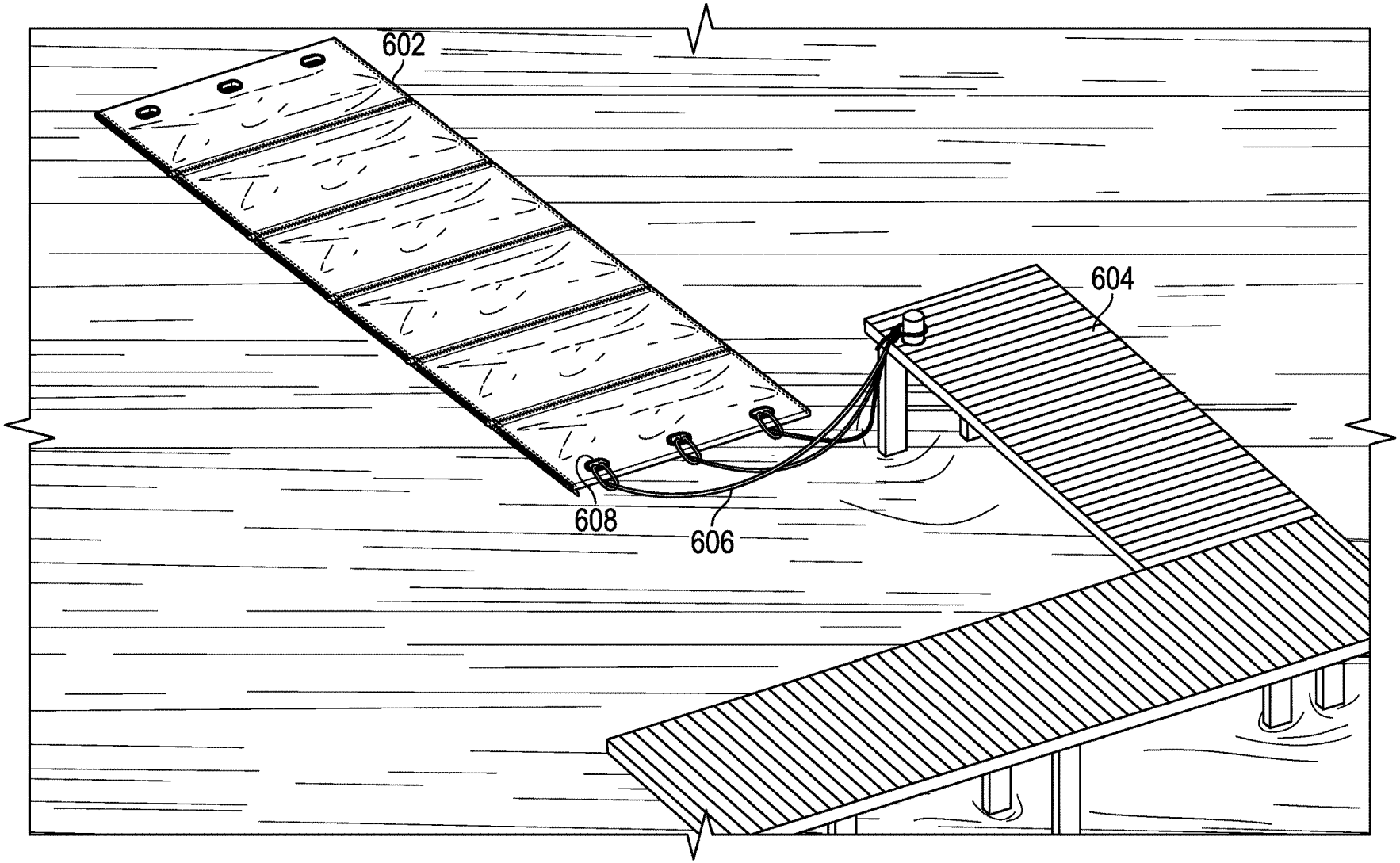
FIG. 6 depicts an assembled mat secured to a dock by tethers.

FIG. 6 depicts an exemplary embodiment where an assembled mat 602 is attached to a dock 604. The mat 602 is secured to the dock 604 by a tether 606 attached to grommeted port 608 of the mat 602. Since the mat 602 is anchored to a stationary object (the dock 604), many benefits for water activities are provided. The mat 602 may act as a floating dock where the swimmers may rest while remaining in the water. The mat 602 also provides an easy method for getting in or out of the water since the mat 602 is in the water and not several feet above it like a dock or boat may be. The mat 602 may be removed from the dock 604 at either the dock 604 connection point where the tethers 606 are attached to the dock 604, or at the mat 602 connection point. This allows the user to move the mat 602 and leave the tethers 606 attached to the dock 604 for connecting to the same dock 604 at a later time, or to take the tethers 606 for attaching to a different object elsewhere. The user may detach any of the panels from the mat assembly 602 and use the detached panels independently. This allows a user to leave the group and the secured mat 602 while still having an independent floating device. This provides an extra level of safety in the water for swimmers, or could just be a relaxing time alone, or with a close-knit group of friends.

In another exemplary scenario, an embodiment of the invention may use a mat as a raft or fishing vessel. A mat assembly may be used by a user in a sitting position while the mat is rowed to a favorite fishing hole. The oar, fishing pole, tackle box or any other equipment needed may be tied to the grommet ports or the mat may have pockets, hooks, rope, or any other method for attaching the fishing equipment. A fishing stringer may also be tied to the ports or may be attachable by clips, hooks or any fastening method as described above. The mat assembly may include a seat (not illustrated) for the fisherman may be above the water or in the water allowing the fisherman's legs to dangle below. The mat may have a pocket (not illustrated) for a tackle box and a block for hanging lures. A hole (not illustrated) for holding a pole or multiple poles may be built in or attached to the mat using any of the fastening methods described above.

Figure 7:
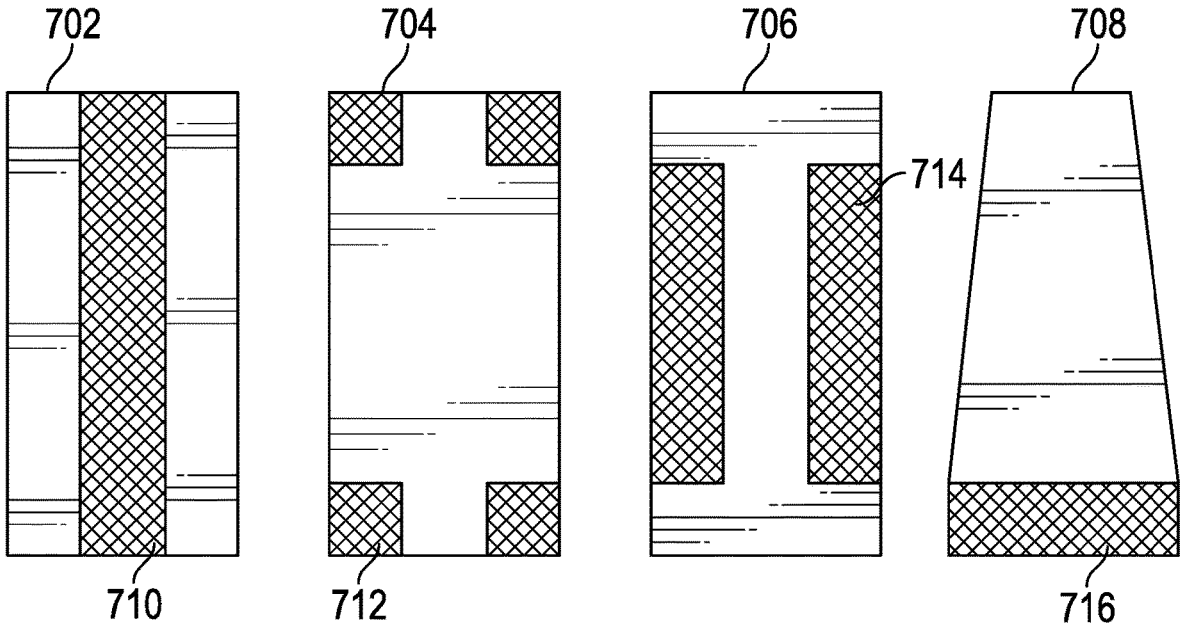
FIG. 7 depicts three sleeves with various mesh patterns.

Additionally, fabric covers, whether for various mat sections 102, may include features to allow water to drain from the interior of the sections. As seen in FIG. 7, edges or sides of a section may be wholly or partially constructed of mesh, allowing water to drain quickly.

FIG. 7 depicts four exemplary embodiments of the sleeves 702, 704, 706 and 708. The sleeve material presents permeable mesh sections 710, 712, 714 and 716 allowing the flow of water. These sections may be along the center or lengthwise as depicted by mesh section 710. Mesh sections 712 are at the corners of sleeve 704, and mesh sections 714 are on the sides of the lengthwise direction of sleeve 706. The mesh section 716 is located on the end of sleeve 708, but may also be on both ends, one edge, or both edges. Any combination of the mesh patterns depicted may be used as well as other patterns not depicted. The mesh 710, 712, 714, and 716 may be, for instance, a knit, woven, or non-woven material that allows water to flow much faster than the fabric of the rest of the cover. The mesh 710, 712, 714 and 716 may be formed of a material such as nylon.

Figure 8:
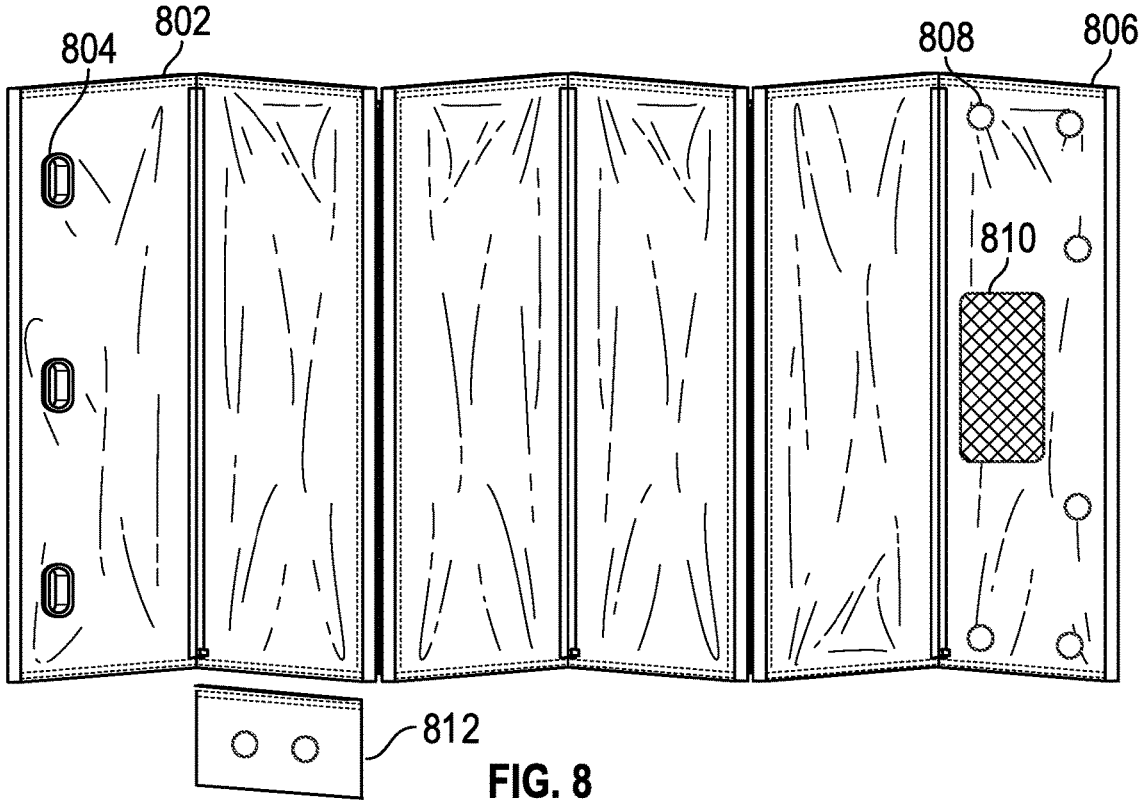
FIG. 8 depicts an assembled mat standing on end in an accordion style.

Embodiments of the invention may be constructed of foam with such firmness that the configurable water mat 100 (labeled as 802 in FIG. 8) is capable of standing on-edge for drying or privacy in a semi-unfolded state, as seen in FIG. 8. The standing configuration, in an accordion style, may provide privacy at a beach or block the wind. Tethers may be secured between the grommets 804 and a nearby tree to provide stabilization in the wind. This configuration may also provide for quick drying in the sun and allow water to more easily exit through the mesh.

FIG. 8 also presents an accessory section 806 that may be available in some embodiments. The depiction of an exemplary embodiment includes drink holders 808 and cooler holder 810 is presented. In embodiments of the invention, the cooler holder 810 and/or the drink holder 808 may include a mesh support 812. FIG. 8 illustrates the cooler holder 810 with the mesh support 812 and the cup holders 808 does not, any structure configured for holding these objects may be used. All holders 808,810 may be plastic, mesh, foam, fabric, or any other method and combination of methods may be used. For example, the holder 808,810 may be formed by cutting away unwanted insert 202. Though a cooler holder 810 and cup holders 808 are depicted, this is in no way limiting.

In embodiments of the invention, the accessory section 806 may additionally or alternatively include water tight pockets (not illustrated) configured to hold electronics, snacks, wallets, toys, goggles, sunscreen, or any other object the user may want to have on the mat. The accessory section 806 may additionally or alternatively include non-water-tight pockets (not illustrated) configured to hold footwear, water toys, goggles, and other objects that would not be harmed by water damage. The pockets may be any type of material as discussed above. The accessory section 806 may additionally or alternatively include large pockets (not illustrated) configured for holding radios, speakers, Bluetooth speakers, computers, monitors, tackle boxes, boat accessories, paddles/oars, or any other larger device may also be present.

The accessory section 806 may attach on any side as in the case of an intermediary section or may have anchors as in the case of an anchor section. Any section may also attach on the ends to form a square, L-shape, H-shape, or any other type configuration. The sections may also be attached using any of the methods previously discussed.

In other embodiments, also depicted in FIG. 8 a mini-accessory section 812 may also be attached to the mat assembly. The mini-accessory section may be a floating cup holder as depicted in FIG. 8, but also may be a water-tight pocket, and may additionally or alternatively include non-water-tight pockets as discussed above. The mini-accessory section may be attached by any of the fastening devices discussed above and to any of the edges and ends of any section.

In other embodiments, a child section (not illustrated) may also be available. The child section may have a seat for a baby, toddler, child, or combination to hold multiple children of different ages. The child section may be reconfigurable so one section may be adjusted to hold different sized children. The child section may have seats of mesh or any other comfortable fabric that the child may sit in. The seat may be in the water allowing the child's legs to dangle in the water or may be above the mat keeping the child out of the water. The seat may have straps to keep the child secure. These straps may fasten by any method as described above. Extra floatation may be added to the section to keep it upright for added stability and security for the child. The section may contain a cup holder and tray for eating and playing. The section may also contain pockets, as described above, for holding toys, pacifiers, or any other devices for child entertainment.

Figure 9:
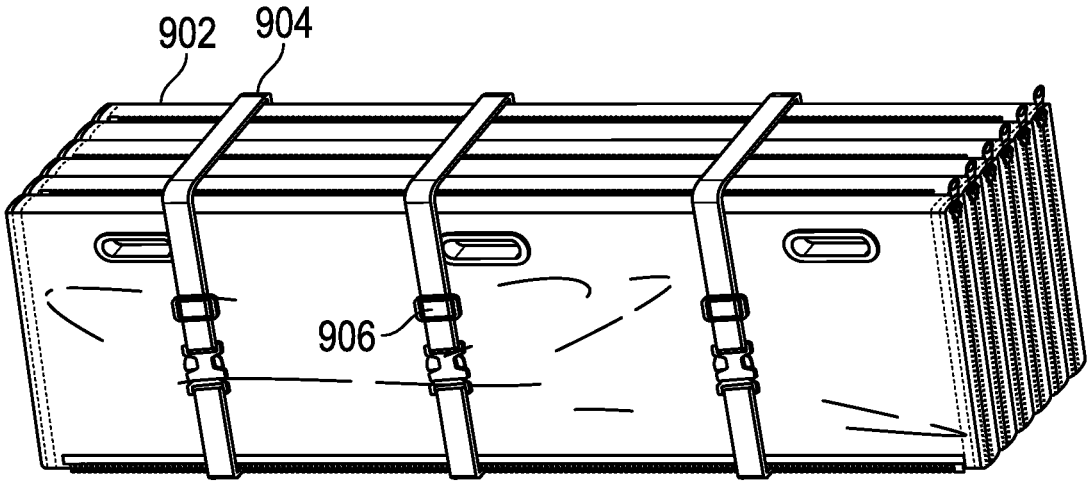
FIG. 9 depicts adjustable straps securing a mat in a stacked configuration.

As seen in FIG. 9, the configurable water mat 100 of embodiments of the invention folds easily for easy stacking, transportation, and storage. Embodiments of the invention may or may not require the sections be unfastened from one another prior to stacking. When stacked, the sections may be bound using an adjustable binding strap 904 made of a material such as (but not limited to) fabric, rope, cord, or chain. The binding strap 904 may be of an adjustable length, perhaps utilizing a sliding strap adjuster 906, such that the strap may be used regardless of the number of middle mat sections desired. The binding strap 904 may be constructed with one or more clips, carabineers, snaps, clasps, buttons, or any other fastening device for connection of its ends to firmly secure the strap 904 around the stack of mat sections 902. The mat sections may include one or more loops, in some embodiments constructed of fabric on each side, such that binding straps 904 may be threaded through the loops to further secure the strap 906 around the stack of mat sections 902. In some embodiments, the tethers discussed above may also function as the binding straps 904.

Though the configurable water mat 100 depicted in FIG. 9 is resting on end, the configurable water mat 100 may lay on a face, or an end, or any way that may be best suited for the space available for storage. In this configuration, the configurable water mat 100 may also still easily dry because of the permeable mesh. The configurable water mat 100 may be stored in such a way that the water is drained through the mesh.

Another benefit of the stacked configuration of the configurable water mat 100 is that it is easily transportable. The grommets on the anchor section 102 provide a handle for carrying. The strap 904 may also be used as a hand hold. In other embodiments, a second strap may be used to loop around one of the straps 904 to provide a shoulder strap for carrying. A benefit of these embodiments is that the configurable water mat 100 is transportable by one user.

Embodiments have been provided mainly for water purposes, however this is not limiting. The mat may be used on the beach for picnics or to escape the hot sand or asphalt. The mat may be used for exercise, such as yoga or palates. The mat may be tethered to a tree for providing shade or privacy as stated above.

As noted above, the fabric covers are removable from the solid foam cores of the anchor and middle mat sections. Removal of the fabric covers allow a user to quickly and conveniently wash, dry, repair, and/or replace covers as needed. Further, removal of the fabric covers allows a user to change the combination of colors displayed by the mat. The covers may be a single color, multiple colors, display a design, and/or form a personalized image across the surface of the mat. The covers may be textured on one or both sides to increase traction, for instance using rubber.

Fabric covers of embodiments of the invention may be provided independently from the solid foam cores. As described above, this allows a user to modify the color of sections, convert middle sections to anchor sections, increase or decrease drainage, and replace damaged covers. Further, the fabric covers may be used to convert a conventional single-section rolled mat into a folding water mat of embodiments of the invention by cutting the rolled mat into sections, providing the solid foam cores. The user, merchant, or a third-party service may perform this conversion. Regardless, provision of the fabric covers without a foam core is intended as being within embodiments of the invention.

In embodiments of the invention, all components, panels, and sections of each mat are replaceable and repairable without compromising other sections. The sleeves, foam, holders, pockets, fasteners, straps and any other component that a panel may have may be repaired. The mat assembly is designed modular to provide this freedom. If a mat is damaged, the mat does not need to be replaced or repaired, only the section that was damaged should be removed. This provides the user with the freedom to continue using the mat while the section is repaired. This also provides the user a lower cost for repair and/or replacement option since the entire mat does not need to be replaced.

The invention has been primarily described in relation to a generally flat rectangular recreational flotation device, but this is not intended to be limiting. Embodiments of the invention may be provided in a circular, triangular, or any other desired shape. Additionally, embodiments could be intended for use as a life preservation device, rather than for recreation. Any flotation device with an adjustable size is intended as being within the scope of the invention.

The invention claimed is:

1. A configurable water mat comprising:

a buoyant insert;

a sleeve including a first face, a second face, a third face, a fourth face, and a fifth face, wherein the second face is adjacent the first face, the third face is adjacent the second face, the fourth face is adjacent the third face, and the first face is adjacent the fourth face, wherein the fifth face is adjacent the first face, the second face, the third face, and the fourth face, wherein the third face is at an opposite side of the fifth face as the first face and the second face is at opposite side of the fifth face as the third face;

at least one tethering port positioned proximate the first face;

an enclosure fastener disposed on the fourth face and operable to enclose the buoyant insert within the sleeve;

an expansion fastener disposed along the third face, mesh disposed on the second face for providing water drainage from inside the sleeve.

2. The configurable water mat of claim 1, wherein the expansion fastener is configured to attach to an additional sleeve at an additional expansion fastener via hook and loop fastener, wherein the enclosure fastener is configured with a hook and loop fastener to enclose the buoyant insert within the sleeve.

3. The configurable water mat of claim 2, wherein the expansion fastener comprises the loop of the hook and loop fastener and the additional expansion fastener comprises the hook of the hook and loop fastener, wherein the additional expansion fastener is disposed on an additional face of the additional sleeve, and wherein additional grommets are disposed on the additional face.

4. The configurable water mat of claim 1, wherein the at least one tethering port is configured with metal grommets and attached to a tether.

5. The configurable water mat of claim 1, wherein the buoyant insert is sufficiently buoyant to support at least one adult human body.

6. The configurable water mat of claim 1, wherein the sleeve further comprises at least one graphic, wherein the expansion fastener is a first expansion fastener; and further comprises a second expansion fastener along the first face.

7. The configurable water mat of claim 1, further comprising an additional section including an additional buoyant insert;

an additional sleeve, wherein the additional sleeve presents additional mesh providing water drainage; and an additional expansion fastener disposed along an additional face operable to couple to the expansion fastener of the sleeve.

8. The configurable water mat of claim 7, wherein the additional expansion fastener is configured with an additional hook and loop fastener for attaching to the sleeve.

9. The configurable water mat of claim 7, wherein the additional sleeve is configured with an additional enclosure fastener comprising an enclosure hook and loop fastener for securing the buoyant insert within the sleeve.

10. The configurable water mat of claim 7, wherein the additional sleeve comprises additional tethering ports, and wherein the additional tethering ports comprise grommets.

11. An anchor section for a configurable water mat comprising:

a buoyant insert;

a sleeve including a first face, a second face, a third face, and a fourth face, and a fifth face, wherein the second face is adjacent the first face, the third face is adjacent the second face, the fourth face is adjacent the third face and the first face is adjacent the fourth face, wherein the fifth face is adjacent the first face, the second face, the third face, and the fourth face, wherein the third face is at an opposite side of the fifth face as the first face and the second face is at opposite side of the fifth face as the third face;

at least one tethering port positioned along the first face and comprising a grommet;

an enclosure fastener disposed on the fourth face and operable to enclose the buoyant insert within the sleeve and comprising an enclosure hook and loop fastener; and an expansion fastener disposed along the third face and comprising an expansion hook and loop fastener, wherein the sleeve comprises mesh on the second face providing water drainage.

12. The anchor section of claim 11, wherein the expansion fastener is a first expansion fastener; and further comprising a second expansion fastener along the first face.

13. The anchor section of claim 11, further configured to couple to an additional sleeve, the additional sleeve comprising:

an additional enclosure fastener for enclosing an additional buoyant insert within the additional sleeve; and an additional expansion fastener disposed along an additional face operable to couple to the anchor section, wherein the additional sleeve presents additional mesh providing water drainage.

14. The anchor section of claim 13, wherein the additional expansion fastener is disposed on a same face of the additional sleeve as an additional tethering port.

15. The anchor section of claim 14, wherein the additional expansion fastener is configured to attach to the expansion faster on the third face of the sleeve.

16. The anchor section of claim 15, wherein the additional tethering port comprises metal grommets.

17. The anchor section of claim 15, wherein the additional sleeve is a first additional sleeve, and further comprising a second additional sleeve including a second additional enclosure fastener for enclosing a second additional buoyant insert within the second additional sleeve; and a second additional expansion fastener disposed along a second additional face operable to couple to the first additional sleeve, wherein the second additional sleeve presents second additional mesh providing water drainage.

18. The anchor section of claim 17, wherein the second additional expansion fastener attaches to the first additional sleeve at a face opposite the additional expansion fastener.

19. A configurable water mat comprising:

a section including a buoyant insert;

a sleeve including a first face, a second face, a third face, and a fourth face, and a fifth face, wherein the second face is adjacent the first face, the third face is adjacent the second face, the fourth face is adjacent the third face and the first face is adjacent the fourth face, wherein the fifth face is adjacent the first face, the second face, the third face, and the fourth face, wherein the third face is at an opposite side of the fifth face as the first face and the second face is at opposite side of the fifth face as the third face;

a first expansion fastener disposed on the first face;

at least one grommet disposed proximate the first face for providing tethering ports;

a second expansion fastener disposed on the second face, an enclosure fastener disposed on the fourth face and operable to enclose the buoyant insert within the sleeve; and mesh disposed on the second face for allowing water to drain from the sleeve;

an additional section including an additional buoyant insert;

an additional sleeve including a first additional face, a second additional face, a third additional face, and a fourth additional face, wherein the second additional face is adjacent the first additional face, the third additional face is adjacent the second additional face, the fourth additional face is adjacent the third additional face and the first additional face is adjacent the fourth additional face, and wherein the third additional face is opposite the first additional face and the second additional face is opposite the third additional face;

at least one additional grommet disposed proximate the first additional face for providing additional tethering ports;

a first additional expansion fastener disposed on the first additional face;

a second additional expansion fastener disposed on the third additional face an additional enclosure fastener disposed on the fourth additional face and operable to enclose the additional buoyant insert within the additional sleeve; and an additional mesh disposed on the second additional face for allowing water to drain from the additional sleeve, wherein the first addition expansion fastener is configured to attach to the second expansion fastener via hook and loop fasteners.

20. The system of claim 19, wherein the sleeve further comprises a fifth face, wherein the fifth face is adjacent the first face, the second face, the third face, and the fourth face, and wherein at least one graphic is displayed on a fifth face.

* * * * *